United States Patent [19]

Adams

[11] Patent Number: 4,791,711

[45] Date of Patent: Dec. 20, 1988

[54] CHILD RESISTANT BUCKLE FOR SEAT BELT RESTRAINTS

[75] Inventor: Wilbur R. Adams, Terre Haute, Ind.

[73] Assignee: Simulators Limited, Inc., Terre Haute, Ind.

[21] Appl. No.: 126,234

[22] Filed: Nov. 27, 1987

[51] Int. Cl.[4] ..... A44B 11/25

[52] U.S. Cl. ..... 24/633; 24/648; 24/664

[58] Field of Search ..... 24/664, 663, 633, 634, 24/636, 648, 574; 292/19; 70/55, 63, 114, 214, 220, 289, DIG. 73

[56] References Cited

U.S. PATENT DOCUMENTS

| | | | |
|---|---|---|---|
| 247,709 | 9/1881 | Sweyea et al. | 24/574 |
| 3,421,347 | 1/1969 | Sotory | 70/63 |
| 3,566,455 | 3/1971 | Kuszynski | 24/633 |
| 3,789,467 | 2/1974 | Aratani et al. | 24/648 |
| 4,502,194 | 3/1985 | Morris et al. | 24/633 |
| 4,624,033 | 11/1986 | Orton | 24/633 |
| 4,674,303 | 6/1987 | Salcone, II | 70/63 |
| 4,675,954 | 6/1987 | Gullickson | 24/633 |

FOREIGN PATENT DOCUMENTS 2823994 12/1978 Fed. Rep. of Germany .

*Primary Examiner*—Victor N. Sakran

*Attorney, Agent, or Firm*—Howard John Barnett

[57] ABSTRACT

A child resistant buckle for seat belt restraints comprising a two-part buckle in which the female part, or part containing the release button, has a multi-part release button which can only be operated by a full size hand. A smaller, child's hand, having smaller fingers and thumbs, will not normally apply simultaneous pressure to all of the parts of the release button, which must be actuated simultaneously to release the other part of the buckle.

9 Claims, 1 Drawing Sheet

CHILD RESISTANT BUCKLE FOR SEAT BELT RESTRAINTS

BACKGROUND OF THE INVENTION

1. Field of the Invention

This invention is directed to a child resistant buckle for seat belt restraints, and more particularly to a two-part buckle in which the female side includes a three-part release button which can only be operated by a full size hand. Because a child's hand is smaller, the fingers will normally not apply simultaneous pressure to all three parts of the release button 2. Description of the Prior Art U.S. Pat. No. 4,624,033 show a child safety seat belt securement device which includes a housing for at least partially covering the release button of a female seat buckle so that direct access to the release button is substantially restricted. The housing, which fits over the conventional female seat belt buckle, is provided with a complex mechanism for releasing the seat buckle. A button on top of the housing must be actuated while simultaneously squeezing a pair of lock finger caps on the respective sides of the housing. In order to effect a release of this device, two hands are required. In an emergency situation when only minutes or seconds are available to remove a child from a vehicle, release of this seat belt buckle could prove to be too complicated for reflex operation.

The more recent U.S. Pat. No. 4,674,303 issued to Salcone is also directed to a housing which fits over a conventional female seat belt buckle to prevent a small child from disconnecting the seat belt, but permitting disconnection by an adult. However, in order for an adult to disconnect a seat belt provided with the above housing, it is necessary to insert a key in a slot on top of the housing to depress the female buckle release button. Not all persons faced with an emergency situation will immediately understand how this seat belt buckle is released, and they may not have the required key.

Dutch Patent No. 2,823,994 describes a seat-belt locking clip which includes clasp plates with hooks engaging a lateral pin fitted in a lock frame. The locking assembly includes two parts fitted with an internal spring, each of which is provided with opposite actuating buttons. When both buttons are compressed together, the locking assembly unlocks and releases the seat belt. This device represents a substantial departure from conventional seat belt buckles, and would be unfamiliar to most vehicle operators. It would appear to be more complex and therefore more expensive to manufacture. Some adults with arthritis might find this device very difficult to operate, and it does not seem to be very child-proof, since the the obvious squeezing action could be readily accomplished by a child using two hands.

SUMMARY OF THE INVENTION

This invention provides a relatively simple child resistant buckle for seat belt restraints which normally prevents a small child from disconnecting the seat belt while the carrier vehicle is in motion, thereby increasing the child protection from sudden stops and other accidents. Although a small child cannot readily activate the release mechanism of this buckle, an adult can readily release it, almost by reflex reaction, because for the adult sized hand, it operates just like a conventional seat belt buckle release.

The subject buckle is of standard size and shape of the buckles currently in use in the transportation industry, and this novel buckle is designed to minimize additional expense, while providing an effective child resistant buckle. The only mechanical difference of the subject buckle from a conventional seat belt buckle is that the female section of the buckle which houses the male buckle retainer has a three-part release button, all parts of which must be simultaneously actuated to release the subject seat belt buckle. If any one of the three parts of the release button is not actuated, the retainer continues to function, and will not release the male buckle section from the female section. The normal, full-sized adult fingers or thumbs can effect immediate release of the buckle, whereas the smaller fingers and thumbs of a small child can only accomplish release with great difficulty, and with the use of more than one finger, and probably both hands.

DESCRIPTION OF THE PREFERRED EMBODIMENT

Figure 1:
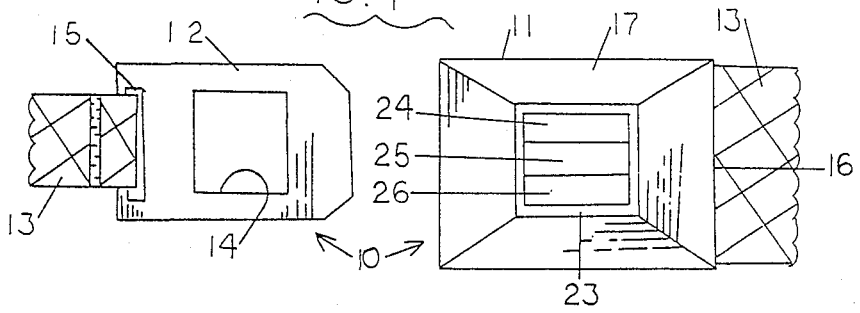
FIG. 1 of the drawings is a top plan view with parts broken away showing the male section and the female section of the child resist ant buckle.
Figure 2:
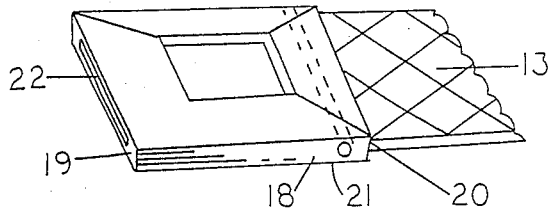
FIG. 2 is a perspective view with some parts shown in phantom of the female section of FIG. 1 showing the end slot into which the male section is received, and showing the top opening which provides access to the three-part release button of the buckle.

As shown in the drawings, a child resistant seat buckle 10 comprises a female section 11 and a male section 12, each connected at their respective outer ends to a suitable belt 13 for restraining a passenger during movement of the vehicle in which the passenger is riding. The vehicle may be any device capable of motion, including, but not limited to, aircraft, land vehicles, boats, bicycles, amusement rides and the like, in which passenger restraint systems are required or desirable. It is also contemplated that the buckle or coupling can be adapted for use in any child restraint system where limiting the movement of a small child is desirable.

Figure 3:
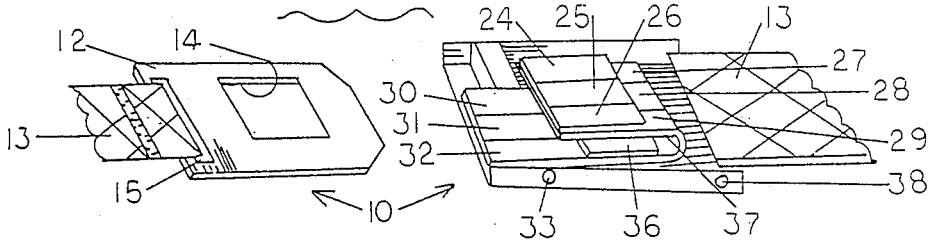
FIG. 3 is a perspective view of FIG. 1 with parts broken away, and parts shown in phantom illustrating the three-part buckle release system, including the fulcrum biasing means.
Figure 4:
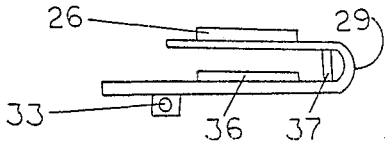
FIG. 4 is a side sectional view showing the relationship of the parts of the release system shown in FIG. 3.
Figure 5:
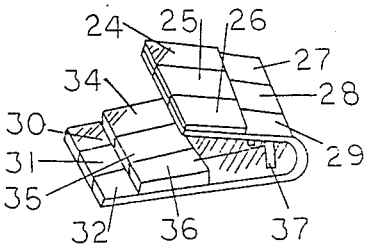
FIG. 5 is a perspective view of the release system parts shown in FIG. 4.
Figure 6:
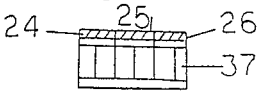
FIG. 6 is an end view of FIG. 4, showing the stiffening members and their relative disposition between the parts of the release system of the invention.

The male section 12 includes a generally square opening 14 extending therethrough which cooperates with the female section 11 to provide retaining and release means for the restraint belt 13. Also shown in FIG. 1 is a slot-like opening 15 for securing restraint belt 13 to the male section 12. The female section 11 is provided with a rodlike retaining means 38 shown in FIG. 3 disposed at the outer end of the female section 11 for securing a complementary restraint belt 13 thereto. The female section 11 of the restraint belt buckle 10 includes a housing 16 having a top 17, sides 18, inner end 19, outer end 20 and a bottom 21. The inner end 19 is provided with a slotted opening 22 to receive and retain the male section 12 therein by means of the locking and release device described below.

As shown in FIG. 1, the release button 23 comprises three distinct parts 24, 25 and 26. The parts 24, 25 and 26 are each interconnected separately by means of their respective flat, leaf-like, U-shaped members 27,28 and 29 to the inner end of the housing 16 of the female section 11. The U-shaped members 27,28 and 29 are biased upwardly by means of a transversely disposed fulcrum 33 in the housing 16. The fulcrum 33 is inside the housing 16, and extends parallel to the inner end 19, and adjacent thereto. The U-shaped members 27, 28 and 29 are anchored in place inside the housing 16 at their respective inner ends 30,31 and 32.

In the normal, locked position of the restraint belt buckle 10, the male section 12 of the buckle 10 is inserted through the slotted opening 22, and is retained in place by upwardly biased retainer plates 34, 35 and 36 which are rigidly attached to the repective, flat, leaflike, U-shaped members 27,28 and 29, and spaced from the respective ends 30, 31 and 32 so that retainer plates 34, 35 and 36 are urged into locking engagement with the generally square opening 14 of the male section 12 of the retraint belt buckle 10. Stiffener members 37 are provided near the outer, upwardly curved mid-portions of each of the U-shaped members 27, 28 and 29 to insure that depression of the release button parts 24, 25 and 26 will depress the retainer plates 34, 35 and 36 sufficiently to permit release of the male buckle 12.

Since each of the retainer plates 34, 35 and 36 is actuated separately by their respective button parts 24, 25 and 26 of release button 23, it can be seen that release of the male section 12 of buckle 10 from the female section 11 can only be accomplished when all three button parts 24, 25 and 26 are depressed simultaneously. When an adult finger or thumb operates the three-part release button 23, all of the button parts 24, 25 and 26 can be depressed together to effect release. However, when a small child attempts to operate the release button 23, the smaller fingers or thumbs can only cover the three parts of the button with great difficulty, thereby assuring safer control of the child restraint system during the crucial times when the vehicle is in motion In the event of an emergency, when quick release of the restraint system is required, an adult can operate the release system without a need for complicated and specially coordinated release motions by merely then using the normal release motion of pressing the threepart release button 23, a motion common to most conventional seat belts.

Compared to other proposed child resistant seat belt buckles, the buckle of the subject invention is much simpler in design and, therefore, it is less expensive to manufacture. The only basic change in design from a conventional seat belt buckle is the three-part release button, all parts of which must be operated simultaneously to effect release of the buckle.

This child resistant buckle can be modified within the scope of the invention to modify it for use in any child restraint system which should be quickly releasable by an adult-sized finger or thumb. For example, special child seating units having restraint belts can be fitted with a releasable coupling using the concept of the invention. A release button having a plurality of separately movable parts, all of which must be actuated simultaneously to release the coupling of the child restraint is within the scope of the subject invention.

The concept can also be readily adapted for playground equipment, play yard gates and door accesses from and to children's play areas. The important feature of the invention is to provide a multipart release system which requires an adult-size finger or thumb for easy actuation, and which is resistant to actuation by a small child's finger or thumb.

I claim:

1. A child resistant buckle for personal restraints, comprising:

a male section having a generally flat body provided with a central opening therein; and a complementary female section having, (1) a first opening on the top thereof, (2) a multi-part release button disposed inside said female section and operable through said opening, (3) a second, slot-like opening on the inner end of said female section for receiving said male section therein in locking engagement, and (4) a plurality of upwardly biased retaining means normally disposed in said central opening of said male section to lock and retain the buckle in closed position, and a plurality of connecting means, each extending between one part of said multi-part release button and a corresponding retaining means, each part of said release button being adapted to release the corresponding section of the retaining means only when that corresponding part of the release button is actuated, said male section of the buckle being released only when all parts of said release button are actuated simultaneously.

2. The child resistant buckle of claim 1, in which the connecting means extending between the multi-part release button and the retaining means comprises a plurality of flat, leaf-like, U-shaped members, one for each corresponding part of said multi-part release button, and the lower, inner ends of said U-shaped members are attached to said female section at the inner end thereof, fulcrum means disposed under each U-shaped member to urge the retaining means upwardly into locking position when the male section of said buckle is inserted into the female section.

3. The child resistant buckle of claim 1, in which the connecting means comprises a plurality of flat, leaf-like, U-shaped members, each extending between a corresponding part of the release button and a corresponding retaining means, said release button being of sufficient size to substantially prevent release of said buckle by the action of a single finger or thumb of a small child.

4. The child resistant buckle of claim 1, in which all parts of the release button may be readily actuated by a single finger or thumb of an adult, thereby enabling rapid removal of a small child from the restraining device in an emergency.

5. In a child resistant safety restraint, a coupling for closing and opening said restraint comprising:

a female housing having an opening in the top surface thereof; actuating means having a plurality of separately actuatable parts enclosed in said female housing;

a release button disposed in said housing and exposed through said opening on the top side of said female housing, said release button having a corresponding plurality of separately actuatable parts, each of said parts being adapted to separately engage and operate a corresponding part of said actuating means;

a retainer means having a corresponding plurality of separately actuatable parts for retaining a male member in locking engagement with said female housing, said male member being released only when all parts of the release button are actuated simultaneously.

6. The child resistant safety restraint coupling of claim 5, in which the multi-part release button comprises three upwardly biased actuating plates connected separately to three separate retainer plates for retaining the male member of said coupling in said female housing, said actuating plates being adapted to release the male member from said female housing only when all three actuating plates are simultaneously depressed.

7. The child resistant safety restraint coupling of claim 6, in which each actuating plate is connected to a respective retainer plate by means of a U-shaped member having an actuating plate disposed on its upper end and a retainer plate disposed near its lower end, said U-shaped members each being secured to the female housing at their respective lower, inner ends, and means disposed beneath said U-shaped members to urge said retainer plates into locking engagement with said male member of said coupling.

8. The child resistant safety restraint coupling of claim 7, including stiffening members extending between the upper and lower parts of each U-shaped member to insure transmission of release motion from said actuating plates to said retainer plates, to thereby release the male member from the female housing of said coupling.

9. The child resistant safety restraint coupling of claim 5, in which the release button comprises a plurality of laterally disposed members, all of which must be actuated simultaneously to release the coupling, and which are of sufficient size to be resistant to operation by the smaller finger or thumb of a child, but which are readily actuated by an adult-sized finger or thumb.

* * * * *